US006700489B1

(12) United States Patent
Easter et al.

(10) Patent No.: US 6,700,489 B1
(45) Date of Patent: Mar. 2, 2004

(54) HANDHELD CORDLESS DEACTIVATOR FOR ELECTRONIC ARTICLE SURVEILLANCE TAGS

(75) Inventors: Ronald B. Easter, Parkland, FL (US); Robert J. Dostal, Boca Raton, FL (US); Steven V. Leone, Lake Worth, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 389 days.

(21) Appl. No.: 09/723,641

(22) Filed: Nov. 27, 2000

(51) Int. Cl.[7] ..... G08B 13/14

(52) U.S. Cl. ..... 340/572.3; 340/572.1; 340/551; 235/472.01; 235/472.02

(58) Field of Search ..... 340/572.3, 572.1, 340/551; 235/462.01, 472.01, 472.02

(56) References Cited

U.S. PATENT DOCUMENTS

| | | | | | |
|---|---|---|---|---|---|
| 4,318,090 | A | | 3/1982 | Narlow et al. | 340/572 |
| 4,575,624 | A | * | 3/1986 | Klinkhardt | 235/449 |
| 4,920,335 | A | * | 4/1990 | Andrews | 340/572.3 |
| 5,059,951 | A | | 10/1991 | Kaltner | 340/572 |
| 5,187,354 | A | | 2/1993 | Bengtsson | 235/472 |
| 5,210,524 | A | * | 5/1993 | Schwarz et al. | 340/551 |
| 5,315,096 | A | | 5/1994 | Müller et al. | 235/462 |
| 5,801,371 | A | * | 9/1998 | Kahn et al. | 235/472.01 |
| 5,805,065 | A | * | 9/1998 | Schwarz et al. | 340/561 |
| 6,114,961 | A | * | 9/2000 | Denholm et al. | 340/572.3 |
| 6,154,135 | A | * | 11/2000 | Kane et al. | 340/572.3 |
| 6,169,483 | B1 | * | 1/2001 | Ghaffari et al. | 340/572.3 |

FOREIGN PATENT DOCUMENTS

| | | | |
|---|---|---|---|
| EP | 0 355 355 B1 | 1/1994 | G07G/1/00 |

* cited by examiner

*Primary Examiner*—Nina Tong

(57) ABSTRACT

A cordless handheld EAS tag deactivator is provided. The deactivator is housed in a portable handheld housing. An antenna is attached to the housing. The antenna is adapted for transmission of an electromagnetic field, which deactivates EAS tags within the field. An electronic circuit is connected to the antenna to generate the electromagnetic field. A battery contained within the housing is connected to the electronic circuit to power the generation and transmission of the electromagnetic field.

2 Claims, 10 Drawing Sheets

HANDHELD CORDLESS DEACTIVATOR FOR ELECTRONIC ARTICLE SURVEILLANCE TAGS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance (EAS) and more particularly to handheld deactivators for deactivation of EAS tags.

2. Description of the Related Art

EAS systems are well known for the prevention or deterrence of unauthorized removal of articles from a controlled area. In a typical EAS system, tags designed to interact with an electromagnetic field located at the exits of the controlled area are attached to articles to be protected. If a tag is brought into the electromagnetic field or "interrogation zone", the presence of the tag is detected and appropriate action is taken. For a controlled area such as retail store, the appropriate action taken for detection of an EAS tag may be the generation of an alarm. Some types of EAS tags remain attached to the articles to be protected, but are deactivated prior to authorized removal from the controlled area by a deactivation device that changes a characteristic of the tag so that the tag will no longer be detectable in the interrogation zone.

The majority of EAS tag deactivation devices are fixed at a specific location, such as adjacent a point-of-sale (POS) station in a retail environment. If an article is purchased, and for whatever reason the attached EAS tag is not deactivated at the deactivator adjacent the POS station, the EAS tag will set off an alarm at the store exit. To then deactivate the EAS tag, the article must be brought back to the deactivator adjacent the POS station, which causes confusion and customer embarrassment. Handheld deactivators for RF type EAS tags, which are part of a handheld bar-code scanner, are known, but still require the EAS tag to be brought near the POS station, within range of the handheld scanner/deactivator cord, for deactivation.

There is presently a need for a cordless, handheld deactivator that can deactivate EAS tags when they are away from or "remote" from the hardwired deactivator near the POS station.

BRIEF SUMMARY OF THE INVENTION

The present invention is a cordless handheld EAS tag deactivator. The deactivator is housed in a portable handheld housing. An antenna is attached to the housing. The antenna is adapted for transmission of an electromagnetic field, which deactivates EAS tags within the field. An electronic circuit is connected to the antenna to generate the electromagnetic field. A battery contained within the housing is connected to the electronic circuit to power the ageneration and transmission of the electromagnetic field.

The invention can be adapted for use for various types of EAS tags including but not limited to RF, microwave, harmonic, and magnetomechanical EAS tags. For example, the antenna can be an RF antenna for transmitting an electric field for deactivation of RF EAS tags. The antenna can be a coil for transmitting a magnetic field for deactivation of magnetomechanical EAS tags. In addition, the invention can be configured to detect EAS tags.

The invention can include a method for entry of data and control instructions, and a display for displaying information to an operator. A battery charger is adapted to receive the housing with the battery electrically connected to an exterior of the housing for connection to the charger. A releasable lock secures the housing to the charger until released by entry of a user identification code.

Objectives, advantages, and applications of the present invention will be made apparent by the following detailed description of embodiments of the invention.

DETAILED DESCRIPTION OF THE INVENTION

The present invention can be adapted for use with a plurality of different EAS tag types. The most challenging embodiment will be used as an example herein, and is the embodiment used for deactivation of magnetomechanical EAS tags, which requires generation of a magnetic field for deactivation. The problem of generating a magnetic field of a particular strength and shape is equivalent to that of driving a coil (inductor) with an electric current of the necessary amplitude and shape as that of the desired magnetic field. The necessary field shape for deactivation is alternating in polarity with a decaying envelope. The major problem for a handheld cordless EAS tag deactivator, however, is to find a way to implement the electrical requirements in a hardware package that has low enough weight and energy requirements. The low weight requirement is necessary to minimize operator fatigue and the low energy requirement is necessary to make battery operation feasible. A deactivation range of at least about 3 inches, a weight of less than about 2 pound, and a battery life of at least about 12 hours with a deactivation rate of 200 per hours is desired.

Figure 1:
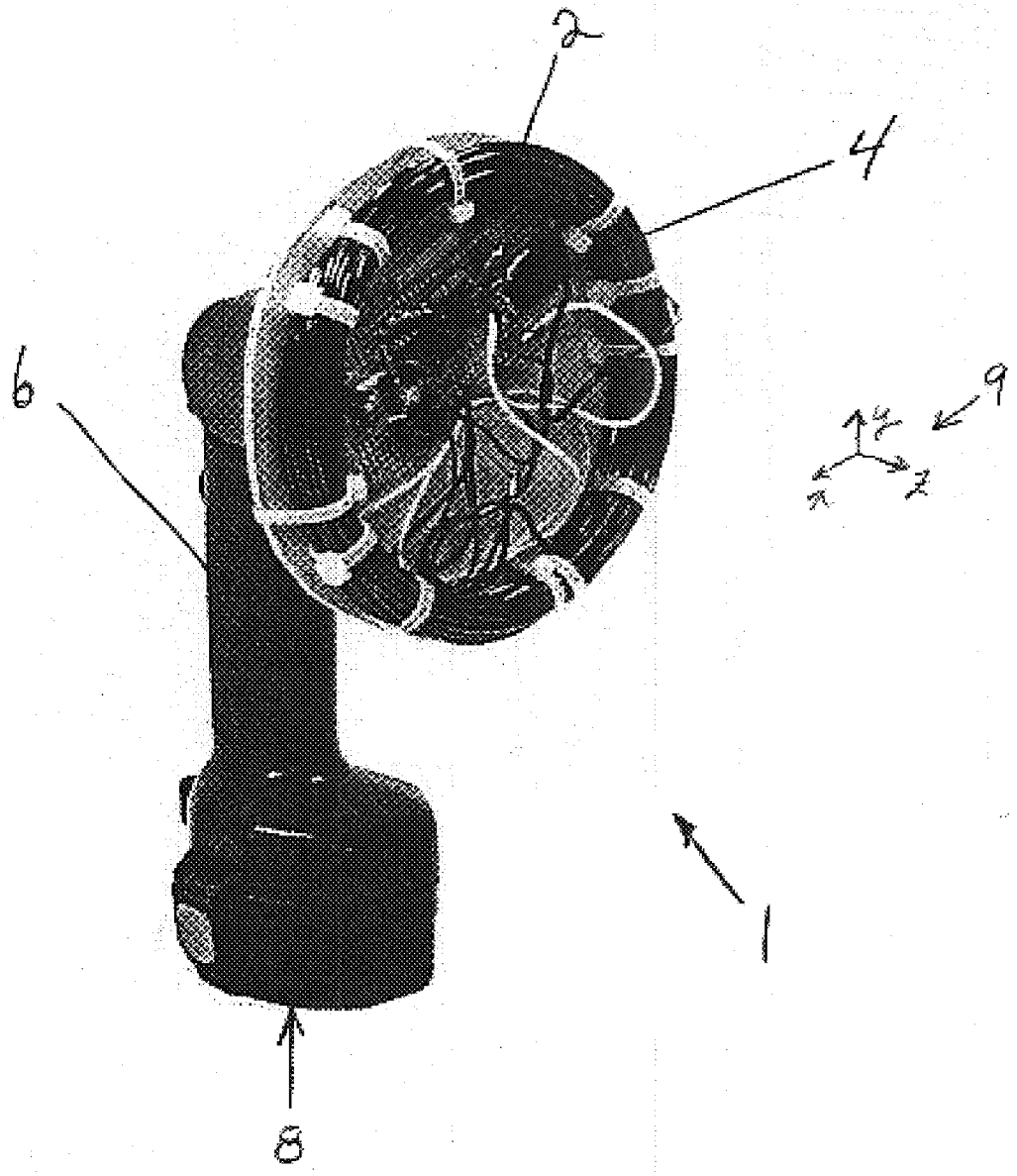
FIG. 1 is a perspective view of one embodiment of the present invention.

Referring to FIG. 1, one embodiment of the present invention 1, includes a substantially circular air-core coil 2, an electronic circuit 4, a handheld housing 6, and a battery 8. The selection of coil size and amp-turns to achieve the required field level for deactivation of magnetomechanical EAS tags out to at least about 3 inches from coil 2, while minimizing weight and battery energy, is determined using computer simulation as further explained below. Battery 8 can be contained fully within housing 6, or plugged into a mating connector and attached to housing 6 in a flush manner.

Figure 2:
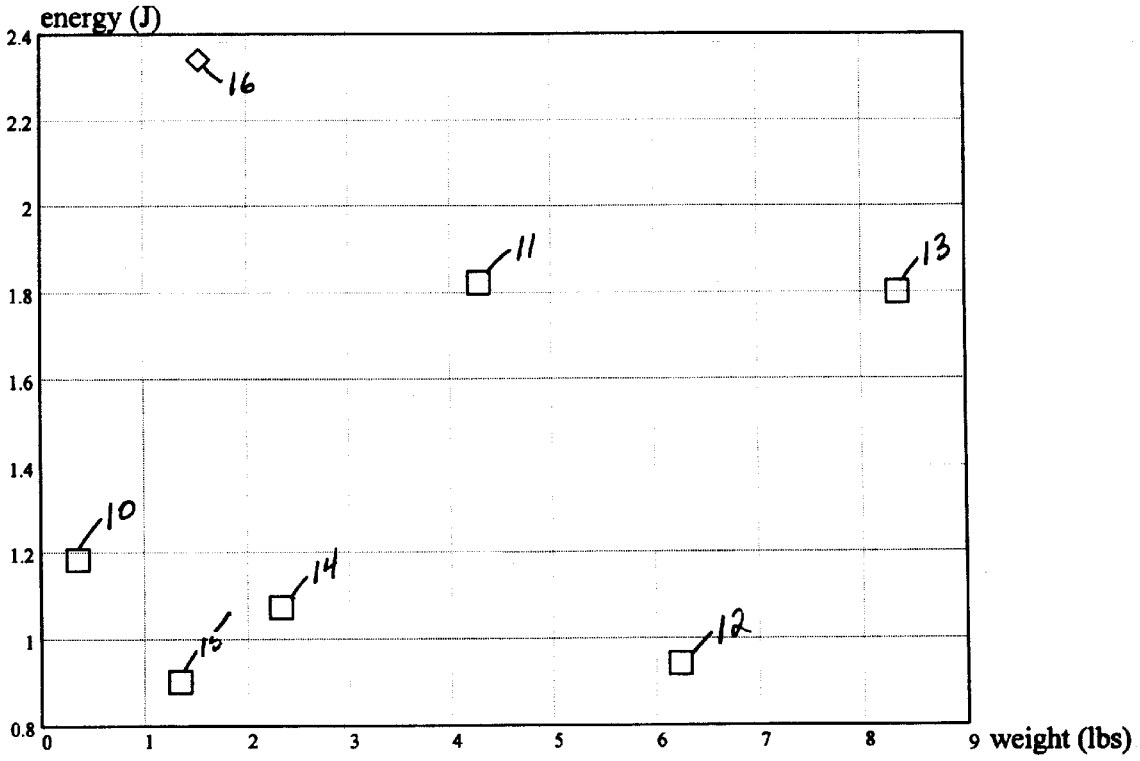
FIG. 2 is a plot of energy requirements and weight per various coil configurations.

Referring to FIG. 2, a plot of deactivation energy requirements verses weight for a number of different sample combinations of coils, cores, and shields is illustrated, each normalized to the same field strength.

Sample 10 is a circular air-core coil, 13 cm in diameter driven at 3500 amp-turns (AT).

Sample 11 is a circular iron-core coil, 13 cm in diameter driven at 3500 AT, with a 12 cm×2 cm core.

Sample 12 is a circular iron-core coil, 13 cm in diameter driven at 2000 AT, with a 12 cm×2 cm core and a 1 cm shield.

Sample 13 is a circular iron-core coil, 13 cm in diameter driven at 2000 AT, with a 12 cm×2 cm core and a 1 cm shield with a 1 cm skirt.

Sample 14 is a circular iron-core coil, 13 cm in diameter driven at 2200 AT, with a 12 cm×0.5 cm core and a 0.5 cm shield.

Sample 15 is a circular air-core coil, 13 cm in diameter driven at 2200 AT, with a 0.5 cm shield.

Sample 16 is a dual U iron-core coil, 2 cm×2 cm cross-section driven at 2500 AT in each of 4 legs.

Figure 3:
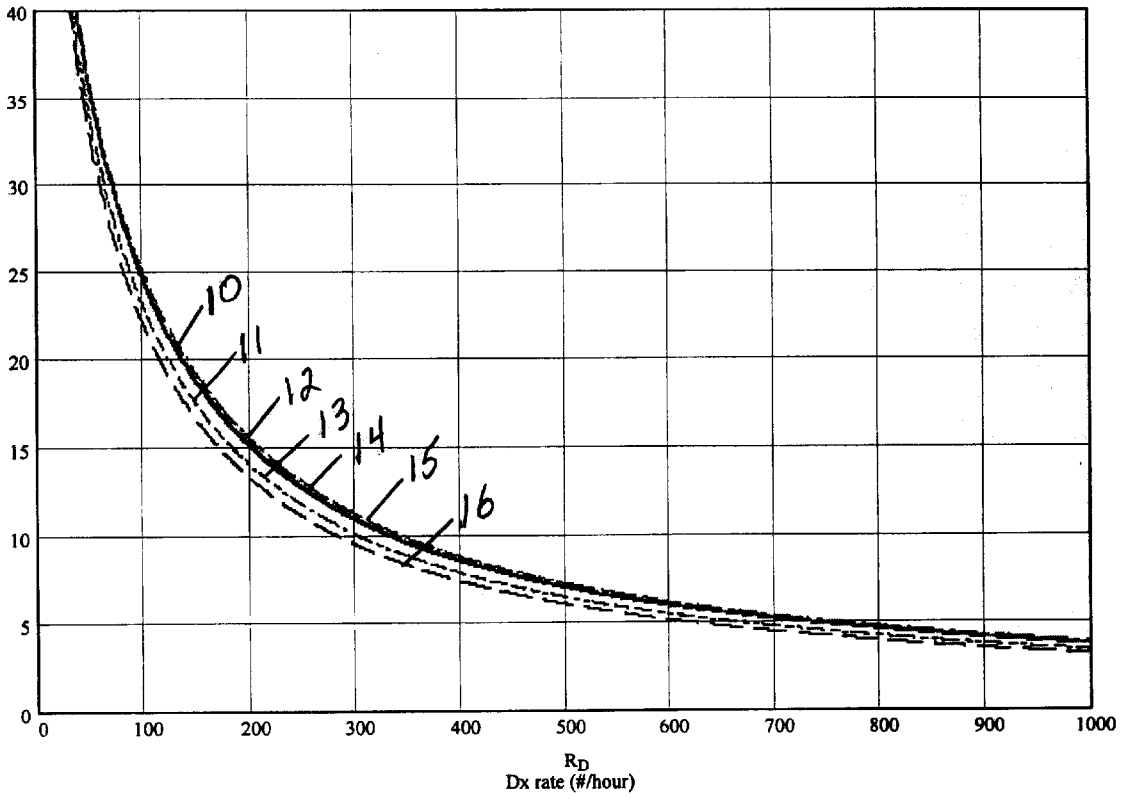
FIG. 3 is a plot of battery life calculations for various deactivation rates.

Referring to FIG. 3, a second plot of samples 10 through 16 illustrates battery life verses deactivation rate per hour for each sample. The plots use the following equation to calculate battery life per deactivation rate:

$$T_B(R_D, E_D) := \frac{E_B}{P_s + P_t + \frac{R_D}{3600}\cdot(E_D + E_{tx} + E_{rc})}\cdot\left(\frac{1}{3600}\right)$$

where;

$E_B$=AH·$V_B$ ·3600 (battery energy (J))=2.592×$10^4$, where

AH=1.0 (battery amp-hours) and $V_B$=7.2 (battery voltage), $E_{tX}$=4 (bias and transmit ($T_x$) energy during deactivation ($D_x$)), $E_{rc}$=1.5 (dissipation in current limiting charging resister (J)), $P_s$=0.06 (bias power during idle for $D_x$), $P_t$=0.05 (bias power for detection), $R_D$=10→1000 ($D_x$ rate per hour), with both $D_x$ and $T_x$ idle between deactivations and during deactivations, bias power and transmit power are both about 4J.

As is apparent from FIGS. 2 and 3, sample 10 provides the best selection of coil parameters of the sample coils investigated. Sample 10, which is a circular air-core coil, 13 cm in diameter driven at 3500 AT, weighs less than 0.5 lbs., requires just below 1.2 J of power, and has a battery life of about 15 hours at a deactivation rate of 200 deactivations per hour. An analogous analysis method can be performed for coil selection for deactivation of other types of EAS tags.

Figure 4:
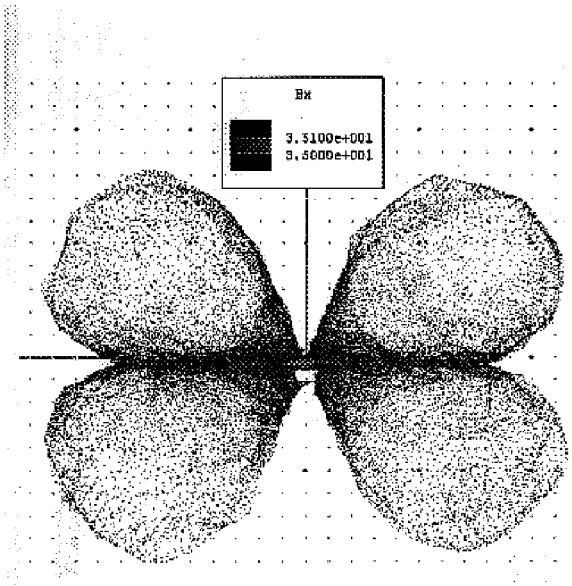
FIG. 4 is plot of the magnetic field in the x-axis, at a constant field level, for one embodiment of the present invention.
Figure 5:
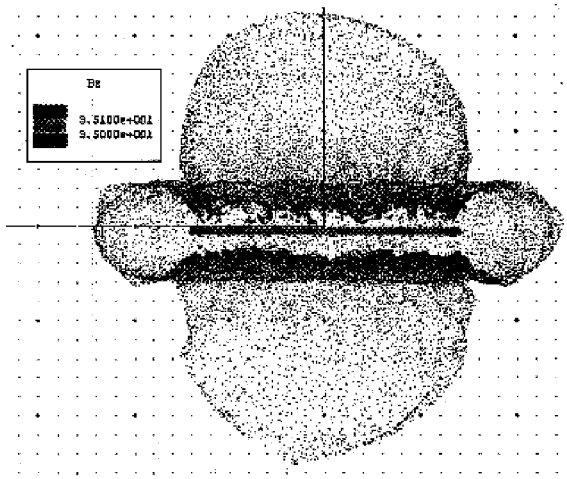
FIG. 5 is plot of the magnetic field in the z-axis, at a constant field level, for one embodiment of the present invention.

Referring to FIGS. 4 and 5, magnetic field plots in the x and z direction, respectively, are illustrated for sample coil 10 with a constant 35 Oersted magnetic field surface. The orientation of the x, y, and z reference axes in relation to the coil are shown at 9 in FIG. 1. The plots have a 1 cm grid and illustrate that the selected coil configuration of sample 10 provides the desired field level for deactivation of magnetomechanical EAS tags at about 3 inches away from the coil.

Figure 6:
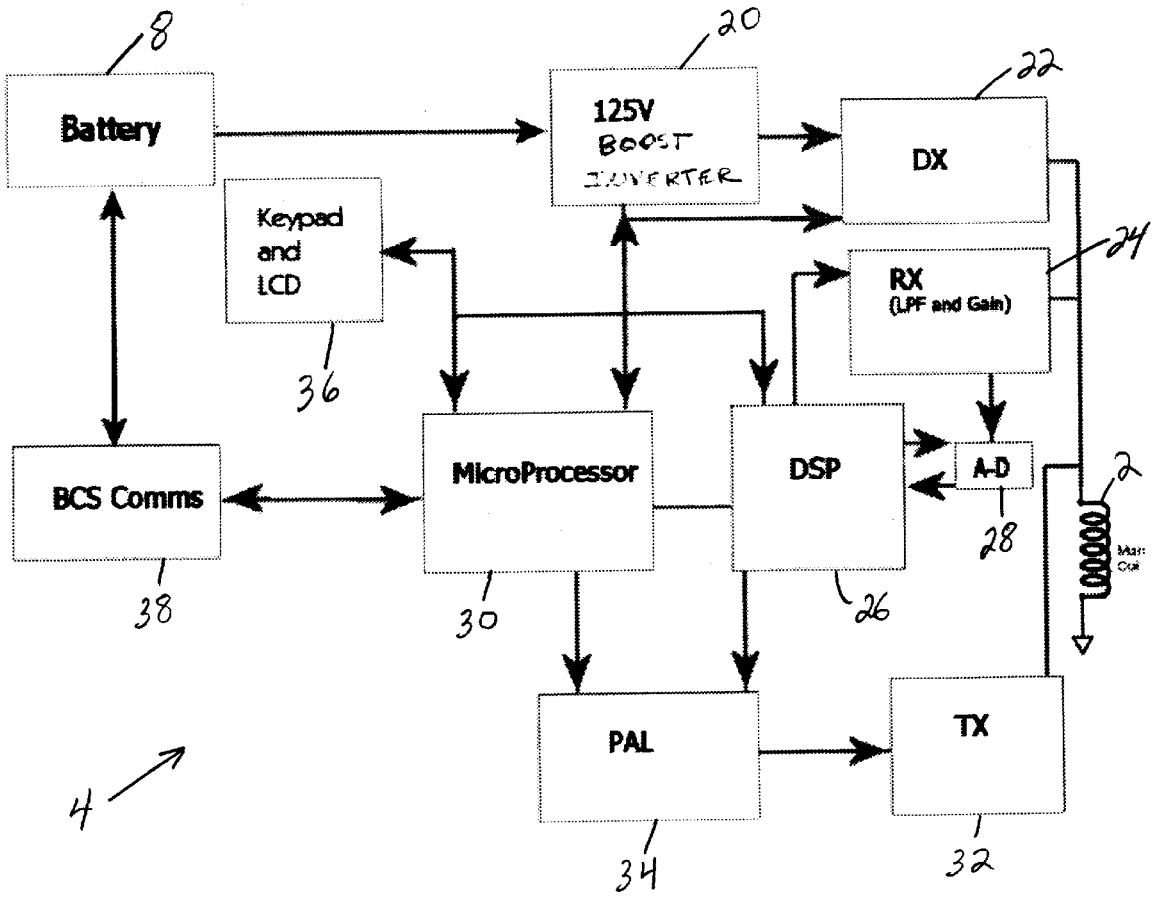
FIG. 6 is a schematic diagram of one embodiment for the electronic circuit of the present invention.

Referring to FIG. 6, one embodiment of electronic circuit 4 is illustrated, and includes battery 8, 125 V boost inverter 20, deactivation ($D_x$) module 22, receive ($R_x$) module 24, digital signal processor 26, A/D converter 28, coil 2, microprocessor 30, transmit ($T_x$) module 32, programmable array logic (PAL) unit 34, keypad and LCD display module 36, and battery charging station (BCS) communication unit 38. Several modes of operation of the present invention are possible, and include manual and automatic, or "hands-free", deactivation and detection only. As well known in the art, when an EAS tag receives the correct transmitted interrogation frequency, the tag resonates and can be detected. Operator input through keypad and LCD display module 36, which communicates with microprocessor 30 and DSP 26, initiates mode selection and operation. Approximately a 1.6 ms burst of the desired interrogation frequency is transmitted by $T_x$ module 32 and coil 2 at a repetition rate of about 36 Hz. PAL 34 ensures proper timing control for the transmitted signal. A typical interrogation frequency for magnetomechanical EAS tags is about 58 kHz, which will be used herein as an example. Depending upon the selected mode of operation, the 58 kHz bursts will continue for 3–4 minutes, or for a preselected period of time for hands-free operation. determines if the return signal is a valid EAS tag signal by examining the returned signal for selected attributes. For example, the returned signal must have proper spectral content and must be received in successive windows as expected. If DSP 26 determines that the returned signal is a valid EAS tag signal, the DSP 26 signals the microprocessor 30 to initiate deactivation, or to indicate the detection of an EAS tag, depending on the particular mode of operation. Indication of an EAS tag detection can take the form of an audio and/or visual alert to the user.

For deactivation, microprocessor 30 signals $D_x$ module 22 to generate an EAS tag deactivation pulse. Dx module 22 utilizes 125 V boost inverter 20 to convert the DC battery voltage of battery 8, to a high current, 125 V alternating pulse having a decaying envelope to deactivate the detected EAS tag. Microprocessor 30 can send commands to a battery charger (fully described hereinbelow) and receive battery 8 and charger status indications through BCS 38.

Figure 7:
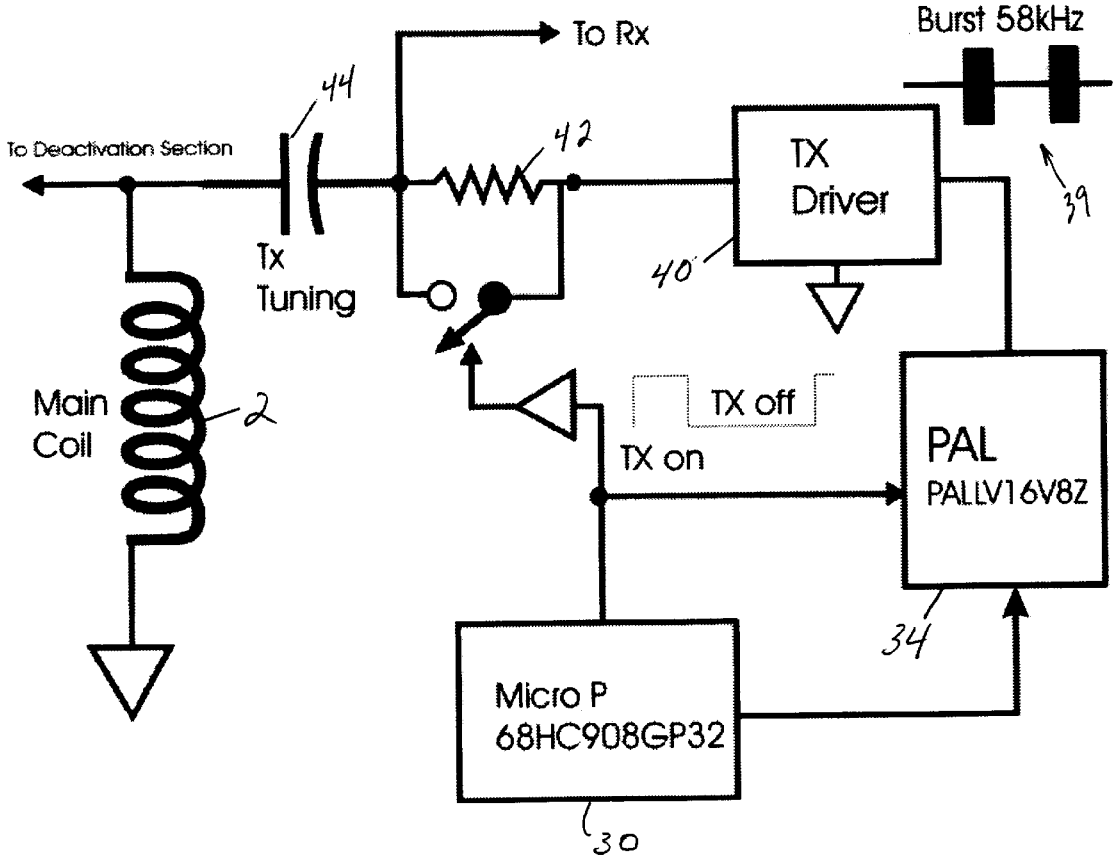
FIG. 7 is a schematic diagram of a transmit module of the circuit shown in FIG. 6.

Referring to FIG. 7, an example of a circuit to implement $T_x$ module 32 is illustrated for generation of a 58 kHz burst 39. Microprocessor 30, shown as a Motorola 68HC908GP32, and PAL 34 shown as a Lattice PALLV16V8Z, as well as other part numbers shown on the schematics herein, are examples of possible component selections only and are not to be limiting. Microprocessor 30 signals PAL 34 to generate the proper transmit frequency and burst rate, which is sent by driver 40, through resister 42 and capacitor 44 to coil 2.

Figure 8:
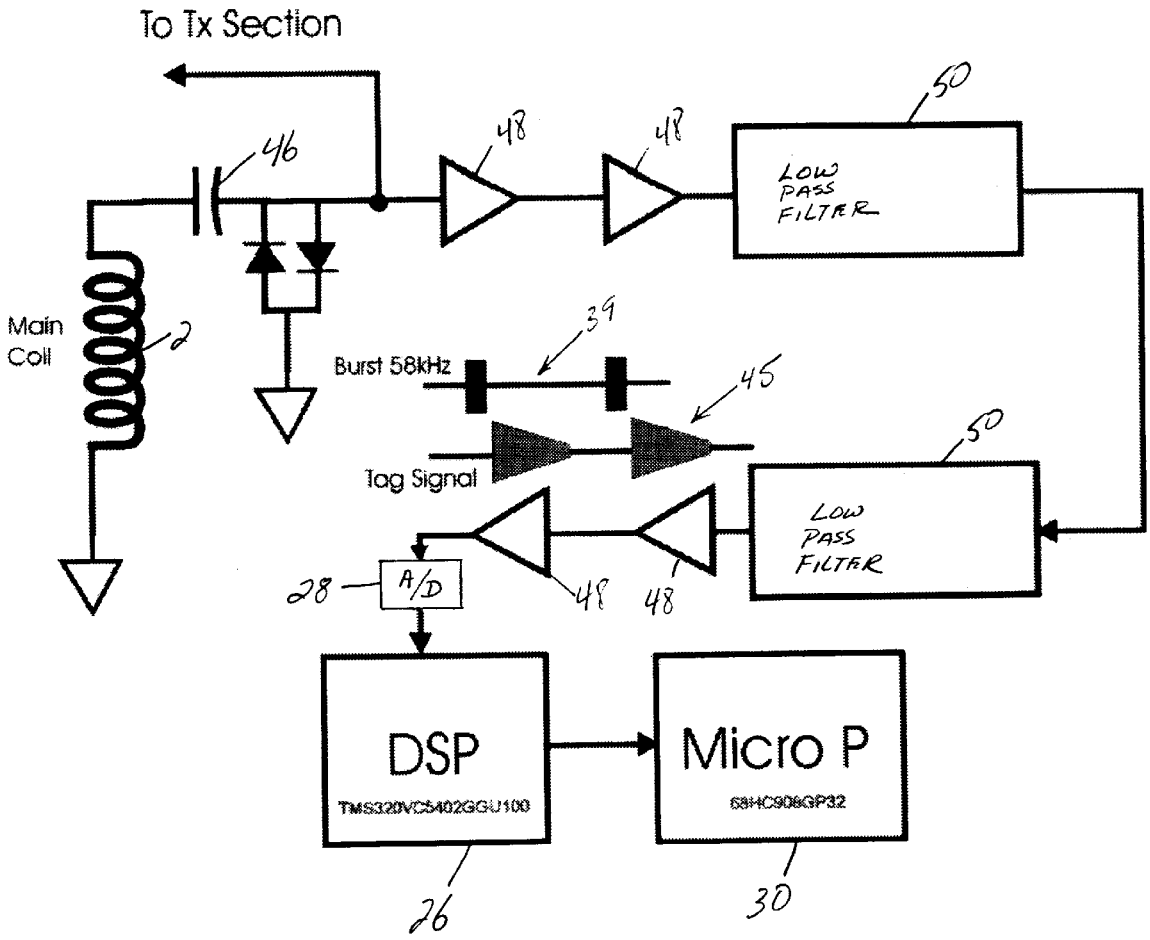
FIG. 8 is a schematic diagram of a receive module of the circuit shown in FIG. 6.

Referring FIG. 8, an example of a circuit to implement the Rx module 24 is illustrated for detecting a return signal 45 from an EAS tag with a resonant frequency of about 58 kHz. The return signal 45 from coil 2 passes through capacitor 46, passes through amplifier 48 and low pass filter 50 stages, and is detected by DSP 26. After verification of valid return signal attributes, DSP 26 signals microprocessor 30 of a valid return signal, which indicates an active EAS tag has been found.

Figure 9:
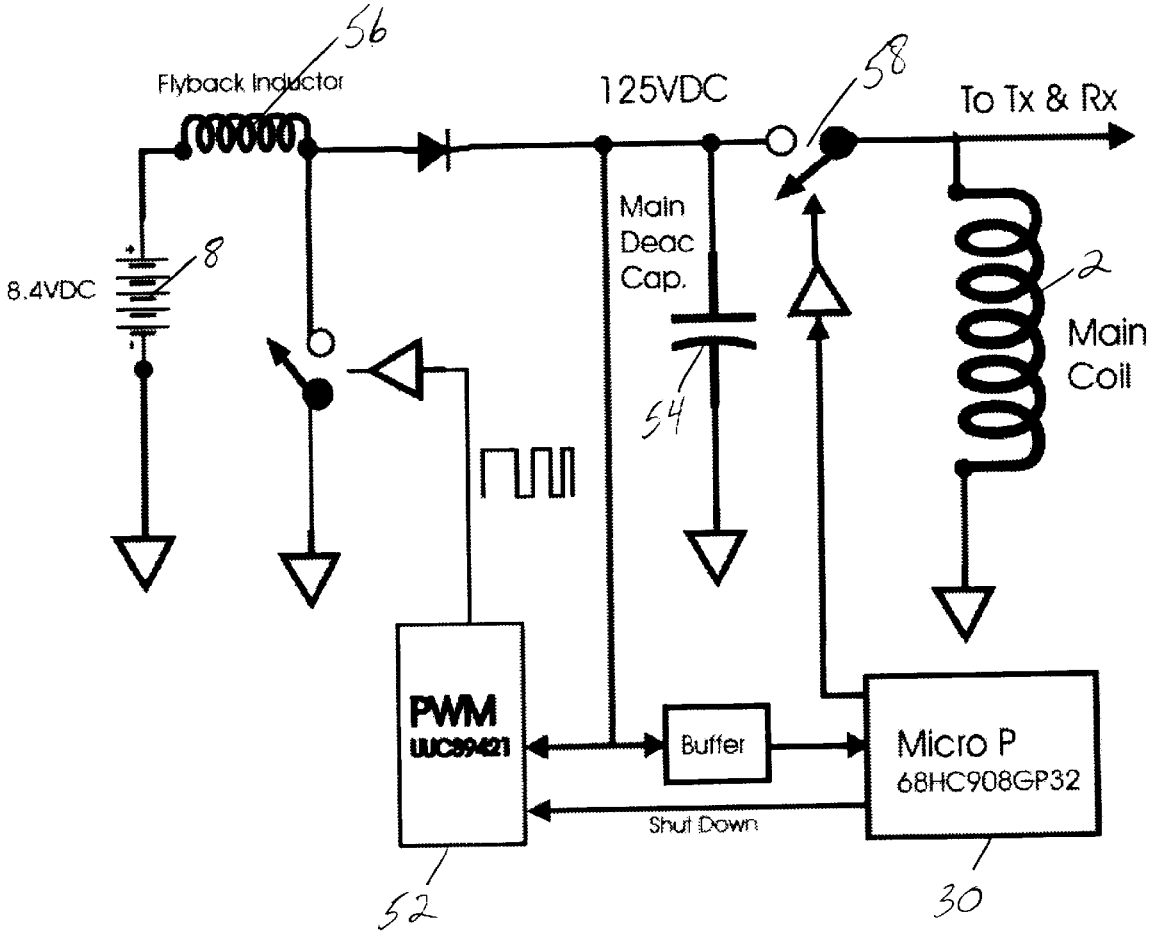
FIG. 9 is a schematic diagram of a deactivation module of the circuit shown in FIG. 6.

Referring FIG. 9, an example of a circuit to implement the $D_x$ module 22 is illustrated for generating the EAS tag deactivation pulse. Pulse width modulator 52, in conjunction with capacitor 54 and inductor 56, form boost inverter 20, shown in FIG. 6, and converts the nominal DC battery voltage from battery 8 to 125 V DC. When switch 58 is closed on command from microprocessor 30, the fully charged capacitor 54 is connected to main coil 2. This initiates a natural resonant discharge producing a decaying alternating sinusoidal current waveform in the main coil 2. The deactivation frequency is approximately 800 Hz with a 25% decay rate. The inductance value, capacitance value and the initial voltage of the capacitor determine the strength of the current waveform. These parameters are sized to produce the magnetic field level of sufficient strength to deactivate an EAS tag out to the desired range of 3 inches. As shown in FIGS. 4 and 5, 35 Oersted is used herein as the desired field strength at 3 inches, however, a field as low as 25 Oersted will deactivate magnetomechanical EAS tags.

All of the components used in the invention have been optimized for both size and energy requirements. Battery 8 can be a pair of high energy density rectangular lithium ion cells tightly packaged together to fit in the allotted space within the handheld housing. PWM 52 can be a Texas Instruments UUC39421, specifically designed for low power battery driven applications, and includes a unique sleep mode, which conserves energy when demand is low. Capacitor 54 can be a high technology, metalized polyester 2 $\mu$M film to enhance energy density, recently made available from NWL, and includes a customized shape to fit within the allotted space within the handheld housing. The complete set of deactivation parameters: field strength, capacitance & charge voltage, coil inductance & resistance, coil size & wire gauge, discharge frequency & decay rate and energy available for each deactivation comprise a unique mathematical solution that is determined according to the specifications of the EAS tag that is to be deactivated and the weight, battery, and component size constraints.

Figure 10:
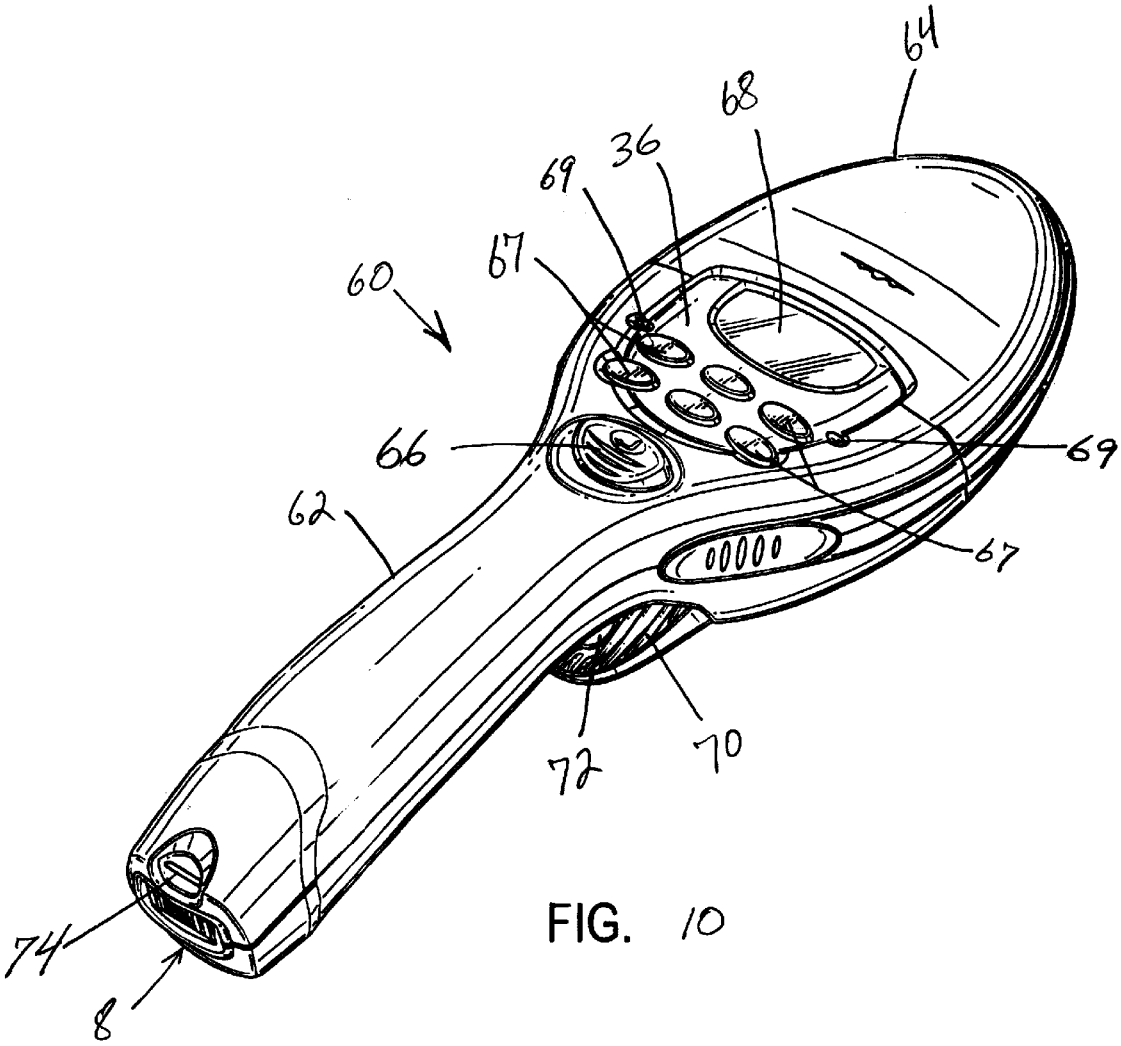
FIG. 10 is a perspective view of an alternate embodiment of the present invention.

Referring to FIG. 10, an alternate embodiment of the handheld deactivator 60 is illustrated including handheld housing 62, keypad and LCD display module 36, battery 8 contained within housing 62, and a coil (not shown) contained within coil end 64 of housing 62. The primary difference between embodiment 1 described above and embodiment 60 is the coil. The coil in embodiment 60 is substantially elliptical in shape rather then circular, and can be comprised of 26 turns of flat copper magnet wire (1.02 mm×2.59 mm), which is equivalent to approximately #13 AWG round wire. This results in an impedance that, to achieve the necessary magnetic field, requires about 3900 amp-turns. Flat wire minimizes eddy current losses in the coil, which tend to degrade the decay rate, as describe above, beyond an acceptable range. Keypad and LCD display module 36 includes pushbutton switch 66, keys 67, display 68, and LEDs 69. Pushbutton switch 66 can be analogous to a trigger or an "enter" key on a computer keyboard to input various operational modes, as fully described herein, which are selected by a user via keys 67. Display 68 can be an LCD, plasma or other suitable display to display information to the user. LEDs 69 can be used to indicate selected information to a user. Cart hook 70 can be used to hang handheld deactivator 60 from a suitable device such as a shopping card, which can be positioned in a desired location, for hands-free operation of the invention. Lock aperture 72 can be used to secure the handheld deactivator for prevention of unauthorized removal.

Figure 11:
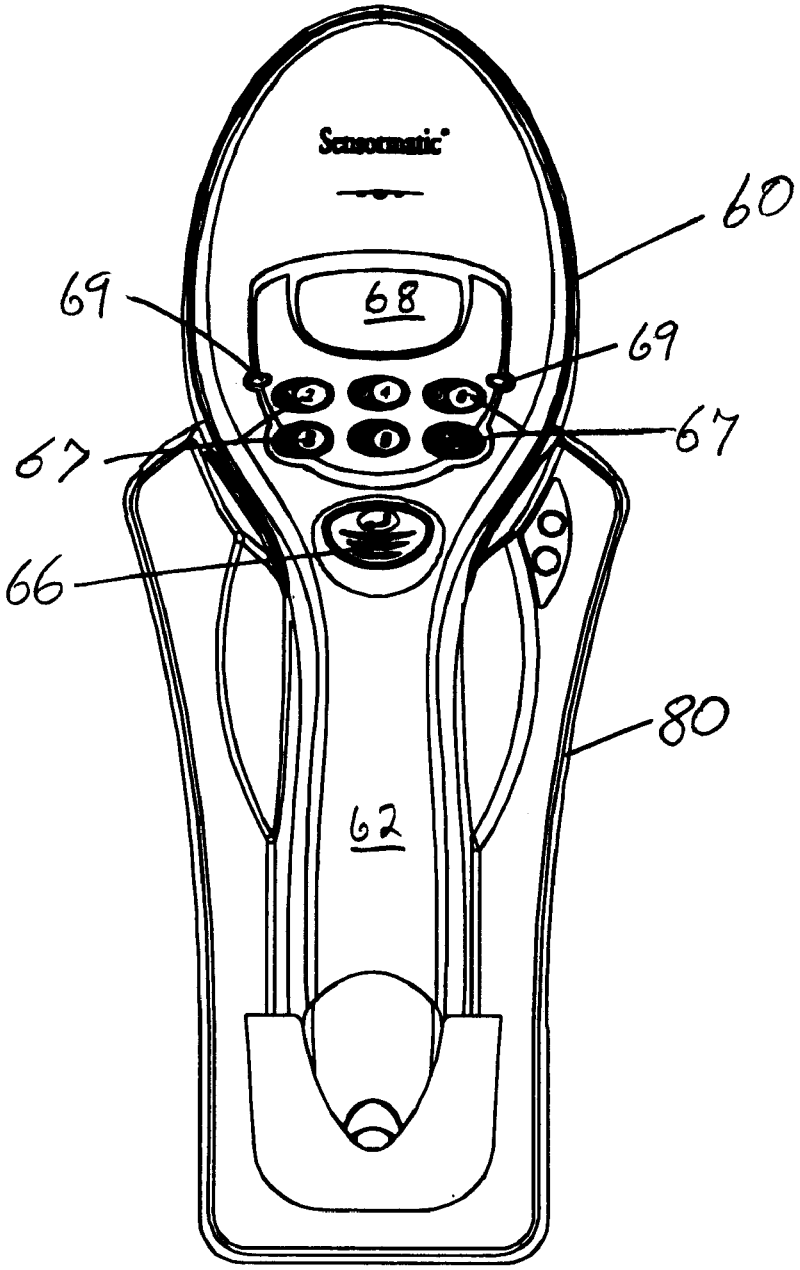
FIG. 11 is a front plan view of the embodiment shown in FIG. 10 while plugged into a battery charging base unit.

Referring to FIG. 11, a battery charging base unit 80 is adapted to receive handheld deactivator 60 as illustrated. Battery 8 within housing 62 can be charged through external connector 74 (shown in FIG. 10). A retractable rod (not shown) can extend from base unit 80 through lock aperture 72 to secure handheld deactivator to base unit 80. To retract the locking 10 rod and release handheld deactivator 80, a suitable identification number must be entered via keys 67. Handheld deactivator 60 communicates with base unit 80, via BCS 38 shown in FIG. 6, to control release of the rod. Similarly, an identification number can be required to be entered prior to operation of the handheld deactivator 60 to prevent unauthorized use. In addition to security features, many operational modes, diagnostic and test routines, and informational requests can be programmed into the handheld deactivator to provide a customized and flexible device. Operational modes can include, but are not limited to, manual detection and deactivation, manual detection and automatic deactivation, manual detection only, automatic detection and deactivation, and sleep. Once a mode is selected via entry by keys 67, the user to initiate the mode can simply use pushbutton switch 66.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A method for deactivation of EAS tags remote from point-of-sale (POS) stations in an environment in which an article of merchandise includes an associated EAS tag, comprising:

presenting an article of merchandise to a POS station for purchase and deactivation of an associated EAS tag;

detecting an EAS tag in an EAS interrogation zone, said EAS tag associated with the article in said presenting step and not deactivated at said POS station;

deactivating said EAS tag with a handheld, cordless deactivator in or adjacent said interrogation zone, and remote from said POS station.

2. The method of claim 1 further comprising detecting said EAS tag with said handheld, cordless deactivator, prior to deactivating said EAS tag with said handheld, cordless deactivator.

* * * * *